US008199013B2

(12) United States Patent
Bergman

(10) Patent No.: US 8,199,013 B2
(45) Date of Patent: Jun. 12, 2012

(54) METAL DETECTION SYSTEM WITH INTEGRATED DIRECTIONAL PEOPLE COUNTING SYSTEM

(75) Inventor: Adam Scott Bergman, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 418 days.

(21) Appl. No.: 12/508,130

(22) Filed: Jul. 23, 2009

(65) Prior Publication Data

US 2010/0039264 A1 Feb. 18, 2010

Related U.S. Application Data

(60) Provisional application No. 61/188,811, filed on Aug. 12, 2008.

(51) Int. Cl.
*G08B 13/12* (2006.01)
*G08B 13/14* (2006.01)

(52) U.S. Cl. ..... 340/568.2; 340/572.1; 340/568.1

(58) Field of Classification Search ..... 340/568.2, 340/572.1, 568.1, 571, 573.1, 3.1, 825.36, 340/825.49
See application file for complete search history.

(56) References Cited

U.S. PATENT DOCUMENTS

| | | | | |
|---|---|---|---|---|
| 4,709,213 | A | 11/1987 | Podhrasky | |
| 4,998,094 | A | 3/1991 | Englmeier et al. | |
| 5,030,941 | A | 7/1991 | Lizzi et al. | |
| 5,414,411 | A | 5/1995 | Lahr | |
| 2004/0239503 | A1 | 12/2004 | Rider et al. | |
| 2006/0069042 | A1 | 3/2006 | Hu et al. | |
| 2007/0046288 | A1 | 3/2007 | Westersten | |
| 2007/0164845 | A1 * | 7/2007 | Ivins et al. | 340/572.1 |
| 2007/0273514 | A1 * | 11/2007 | Winand et al. | 340/568.1 |
| 2008/0309491 | A1 * | 12/2008 | Gillard et al. | 340/572.1 |

FOREIGN PATENT DOCUMENTS

| | | | |
|---|---|---|---|
| DE | 3933684 | A1 | 4/1991 |
| EP | 0736850 | A1 | 9/1996 |
| EP | 0736850 | B1 | 3/2000 |

OTHER PUBLICATIONS

International Search Report and Written Opinion dated Nov. 25, 2009 for International Application No. PCT/US2009/004377, International Filing Date Jul. 28, 2009 (13-pages).

* cited by examiner

*Primary Examiner* — John A Tweel, Jr.
(74) *Attorney, Agent, or Firm* — Alan M. Weisberg; Christopher & Weisberg, P.A.

(57) ABSTRACT

A system for detecting electronic article surveillance ("EAS") marker shielding includes an EAS subsystem, a metal detector, a people counting system, and a processor. The EAS subsystem operates to detect an EAS marker in an interrogation zone. The metal detector operates to detect a metal object in the interrogation zone. The people counting system operates to detect one or more people in the interrogation zone. The processor is electrically coupled to the EAS subsystem, the metal detector and the people counting system. The processor is programmed to receive information outputted from the people counting system and information outputted from the metal detector to determine whether to generate an alarm signal based on the presence of EAS marker shielding.

19 Claims, 3 Drawing Sheets

METAL DETECTION SYSTEM WITH INTEGRATED DIRECTIONAL PEOPLE COUNTING SYSTEM

CROSS-REFERENCE TO RELATED APPLICATION

The present invention is related to and claims priority to U.S. Provisional Patent Application No. 61/188,811, filed Aug. 12, 2008, entitled METAL DETECTION SYSTEM WITH INTEGRATED DIRECTIONAL PEOPLE COUNTING SYSTEM, the entire contents of which is incorporated herein by reference.

STATEMENT REGARDING FEDERALLY SPONSORED RESEARCH OR DEVELOPMENT n/a

FIELD OF THE INVENTION

The present invention relates generally to electronic article surveillance ("EAS") systems and more specifically to a method and EAS system that detects metals and magnetic materials and generates an alarm dependent upon the direction a person is moving.

BACKGROUND OF THE INVENTION

Electronic article surveillance ("EAS") systems are commonly used in retail stores and other settings to prevent the unauthorized removal of goods from a protected area. Typically, a detection system is configured at an exit from the protected area, which comprises one or more transmitters and antennas ("pedestals") capable of generating an electromagnetic field across the exit, known as the "interrogation zone". Articles to be protected are tagged with an EAS marker that, when active, generates an electromagnetic response signal when passed through this interrogation zone. An antenna and receiver in the same or another "pedestal" detects this response signal and generates an alarm.

Because of the nature of this process, other magnetic materials or metal, such as metal shopping carts, in proximity to the EAS marker or the transmitter may interfere with the optimal performance of the EAS system. Further, some unscrupulous individuals utilize EAS marker shielding, such as bags that are lined with metal foil, with the intention to shoplift merchandise without detection from any EAS system. The metal lining of these bags can shield tagged merchandise from the EAS detection system.

Conventional systems for detecting metals and magnetic materials are known, for example, U.S. Pat. No. 4,709,213, entitled "Metal Detector Having Digital Signal Processing," U.S. Pat. No. 5,414,411, entitled "Pulse Induction Metal Detector," and United States Patent Application Publication No. 2007/0046288, entitled "Hybrid-Technology Metal Detector". Prior systems for using metal detection with EAS systems have also been suggested generally, for example, European Patent No. EP0736850, entitled "Method for preventing shoplifting and electronic theft detection system." However, systems such as these merely provide a metal detection system adjacent to an EAS system, but do not provide any disclosure for the increased efficiency and cost reduction of actually combining these disparate elements into one system.

While EAS marker shielding detectors and metal detectors in general are reliable, they do have weaknesses. For example, merchandise, such as a case of soda cans, can mimic the response of a foil-lined bag due to surface area similarities and trigger false alarms. Thus, the presence of legitimately purchased items may affect the overall reliability of the EAS system. False alarms from metal detectors detract from the merchants' confidence and hurt sales of such systems.

Therefore, what is needed is a system and method for an EAS system to detect metals and more accurately determine whether a detected metal is an EAS marker shield, dependent upon the presence of a person in the interrogation zone and/or the direction the person is moving.

SUMMARY OF THE INVENTION

The present invention advantageously provides a method and electronic article surveillance ("EAS") system for determining the presence of a system circumventing device, such as a metal foil-lined bag. Generally, the EAS system combines the outputs of a metal detection system with that of a people counting system to more intelligently distinguish when a detected metal is a system circumventing device.

In accordance with one aspect of the present invention, a system is provided for detecting EAS marker shielding. The system includes an EAS subsystem, a metal detector, a people counting system and a processor. The processor is electrically coupled to the EAS subsystem, the metal detector and the people counting system. The EAS subsystem operating to detect an EAS marker in an interrogation zone. The metal detector operating to detect a metal object in the interrogation zone. The people counting system operating to detect one or more people in the interrogation zone. The processor is programmed to receive information outputted from the people counting system and information outputted from the metal detector to determine whether to generate an alarm signal based on a presence of EAS marker shielding.

In accordance with another aspect of the present invention, a method is provided for detecting EAS marker shielding. An EAS subsystem is provided to detect electronic article surveillance markers within an interrogation zone. A metallic object is detected within the interrogation zone. A people counting subsystem is provided to detect one or more people in the interrogation zone. If one or more people are detected in the interrogation zone, an alert signal is generated based on the presence of EAS marker shielding.

In accordance with yet another aspect of the present invention, an EAS system controller includes an EAS subsystem, a communication interface and a processor. The processor is electrically coupled to the EAS subsystem and the communication interface. The EAS subsystem operating to detect an EAS marker in an interrogation zone. The communication interface operating to receive inputs from a metal detector and a people counting system. The processor is programmed to receive information outputted from the people counting system and information outputted from the metal detector to determine whether to generate an alarm signal.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
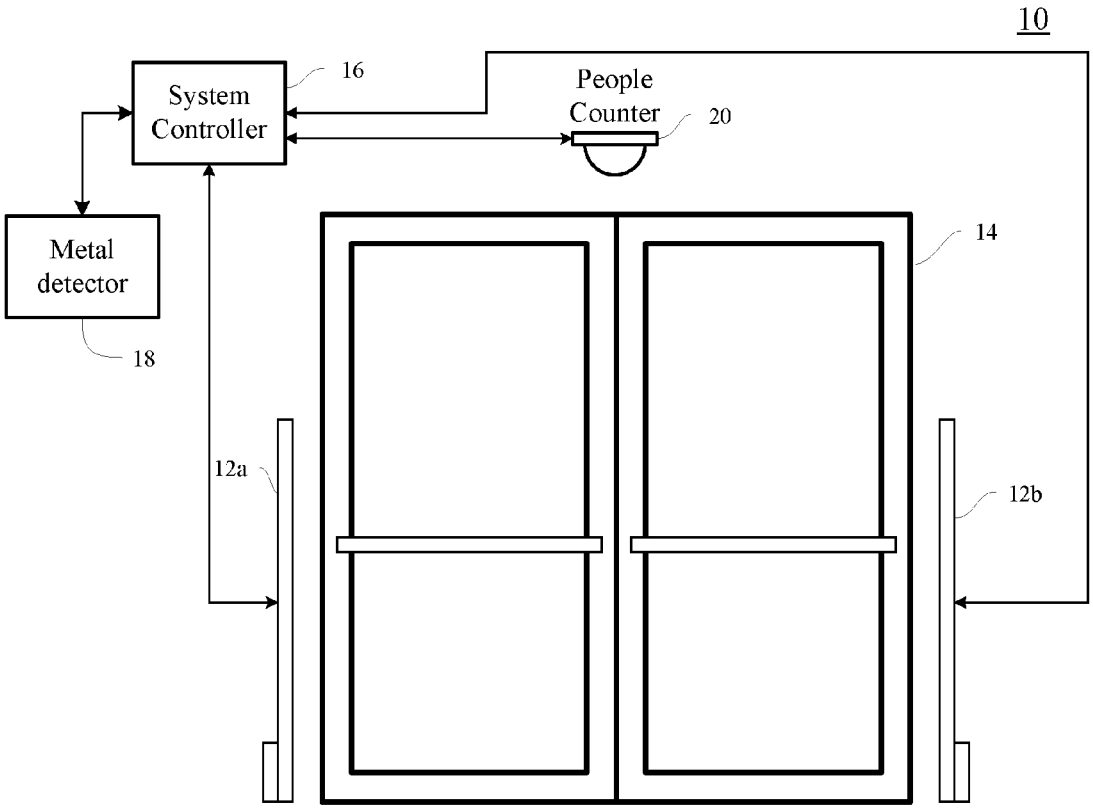
FIG. 1 is a block diagram of an exemplary electronic article surveillance ("EAS") detection system having metal detection and people counting capabilities constructed in accordance with the principles of the present invention.

Before describing in detail exemplary embodiments that are in accordance with the present invention, it is noted that the embodiments reside primarily in combinations of apparatus components and processing steps related to implementing a system and method for improving the accuracy of EAS systems which detect metals and reducing the likelihood of false alarms based on the presence of a person in the interrogation zone and/or the direction in which the person is moving. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a method and system for detecting metal in an interrogation zone of an EAS system and determining whether the detected metal is an EAS marker shield, such as a foil-lined bag. The EAS system combines traditional EAS detection capabilities with metal detection and people counting functions to improve the accuracy of the system, thereby reducing the likelihood of false alarms.

Referring now to the drawing figures in which like reference designators refer to like elements, there is shown in FIG. 1 one configuration of an exemplary EAS detection system 10 constructed in accordance with the principles of the present invention and located, for example, at a facility entrance. EAS detection system 10 includes a pair of pedestals 12*a*, 12*b* (collectively referenced as pedestal 12) on opposite sides of an entrance 14. One or more antennas for the EAS detection system 10 may be included in pedestals 12*a* and 12*b*, which are located a known distance apart. The antennas located in the pedestals 12 are electrically coupled to a control system 16 which controls the operation of the EAS detection system 10. The system controller 16 is electrically connected to a metal detector 18 and a people counting system 20 for more accurately detecting the presence of a foil-lined bag.

The metal detector 18 may be a separate unit, communicatively connected to the system controller 16, or may be integrated into the system controller 16. One exemplary metal detector 18 is disclosed in U.S. patent application Ser. No. 12/492,309, filed Jun. 26, 2009 and entitled "Electronic Article Surveillance System with Metal Detection Capability and Method Therefore," the entire teachings of which are hereby incorporated by reference.

The people counting system 20 may be a separate device, such as an overhead people counter, or may be physically located in one or more pedestals 12 and/or integrated into the system controller 16. Counting the number of visitors entering a location such as a store provides an important indication of overall performance. For example, comparing people counting information to sales transaction data allows retailers to calculate their conversion rate or sales to visitor ratio.

Conversion rate is valuable in helping retailers benchmark store performance across their entire chain and can aid in setting strategies and goals aimed at increasing sales. The people counting system may include, for example, one or more infrared sensors mounted approximately 8 to 14 feet (2.5 m to 4.3 m) above the retailer's entrance/exit. Overhead people counting systems correlate with every retail format and provide the retailer with maximum flexibility and aesthetics. Integrating people counting sensors into the EAS detection pedestal 12 helps to ensure a simple and effective method of delivering essential operational information. In operation, the infrared sensor detects the movement of a person into, through, or out of the predetermined area. That information is collected and processed by the people counting system 20, e.g., using a programmed microprocessor. People counting data may then be transmitted using conventional networking means to other portions of the EAS detection system 10, and/or through the store's internal network or across wide area networks such as the Internet, where it can be sorted, reported and studied.

Figure 2:
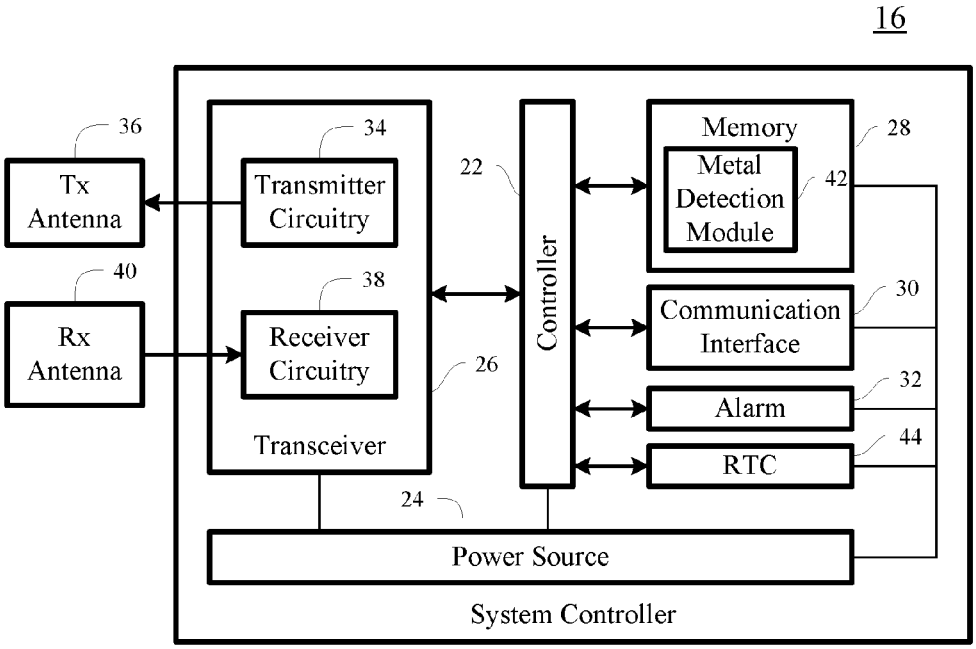
FIG. 2 is a block diagram of an exemplary EAS system controller constructed in accordance with the principles of the present invention.

Referring now to FIG. 2, an exemplary EAS control system may include a controller 22 (e.g., a processor or microprocessor), a power source 24, a transceiver 26, a memory 28 (which may include non-volatile memory, volatile memory, or a combination thereof), a communication interface 30 and an alarm 32. The controller 22 controls radio communications, storage of data to memory 28, communication of stored data to other devices, and activation of the alarm 32. The power source 24, such as a battery or AC power, supplies electricity to the EAS control system 16. The alarm 32 may include software and hardware for providing a visual and/or audible alert in response to detecting an EAS marker and/or metal within an interrogation zone of the EAS system 10.

The transceiver 26 may include a transmitter 34 electrically coupled to one or more transmitting antennas 36 and a receiver 38 electrically coupled to one or more receiving antennas 40. Alternately, a single antenna or pair of antennas may be used as both the transmitting antenna 36 and the receiving antenna 40. The transmitter 34 transmits a radio frequency signal using the transmit antenna 36 to "energize" an EAS marker within the interrogation zone of the EAS system 10. The receiver 38 detects the response signal of the EAS marker using the receive antenna 40.

The memory 28 may include a metal detection module 42 for detecting the presence of metal within the interrogation zone. Operation of the metal detection module 42 is described in greater detail below. The metal detection module 42 may determine whether to trigger the alarm 32 by analyzing output information received from the metal detector 18 and the people counting system 20 via the communication interface 32. For example, if the people counting system 20 has just detected the passage of a person through the interrogation zone and the metal detector 18 has just detected a source of metal that fits the characteristics of a foil-lined bag, the metal detection module 42 may trigger the alarm 32 by sending an alarm signal via the controller 22. The alarm 32 alerts store security or other authorized personnel who may monitor or approach the individual as warranted.

The controller 22 may also be electrically coupled to a real-time clock ("RTC") 44 which monitors the passage of time. The RTC 44 may act as a timer to determine whether actuation of events, such as metal detection or person counting, occurs within a predetermined time frame. The RTC 44 may also be used to generate a time stamp such that the time of an alarm or event detection may be logged.

Figure 3:
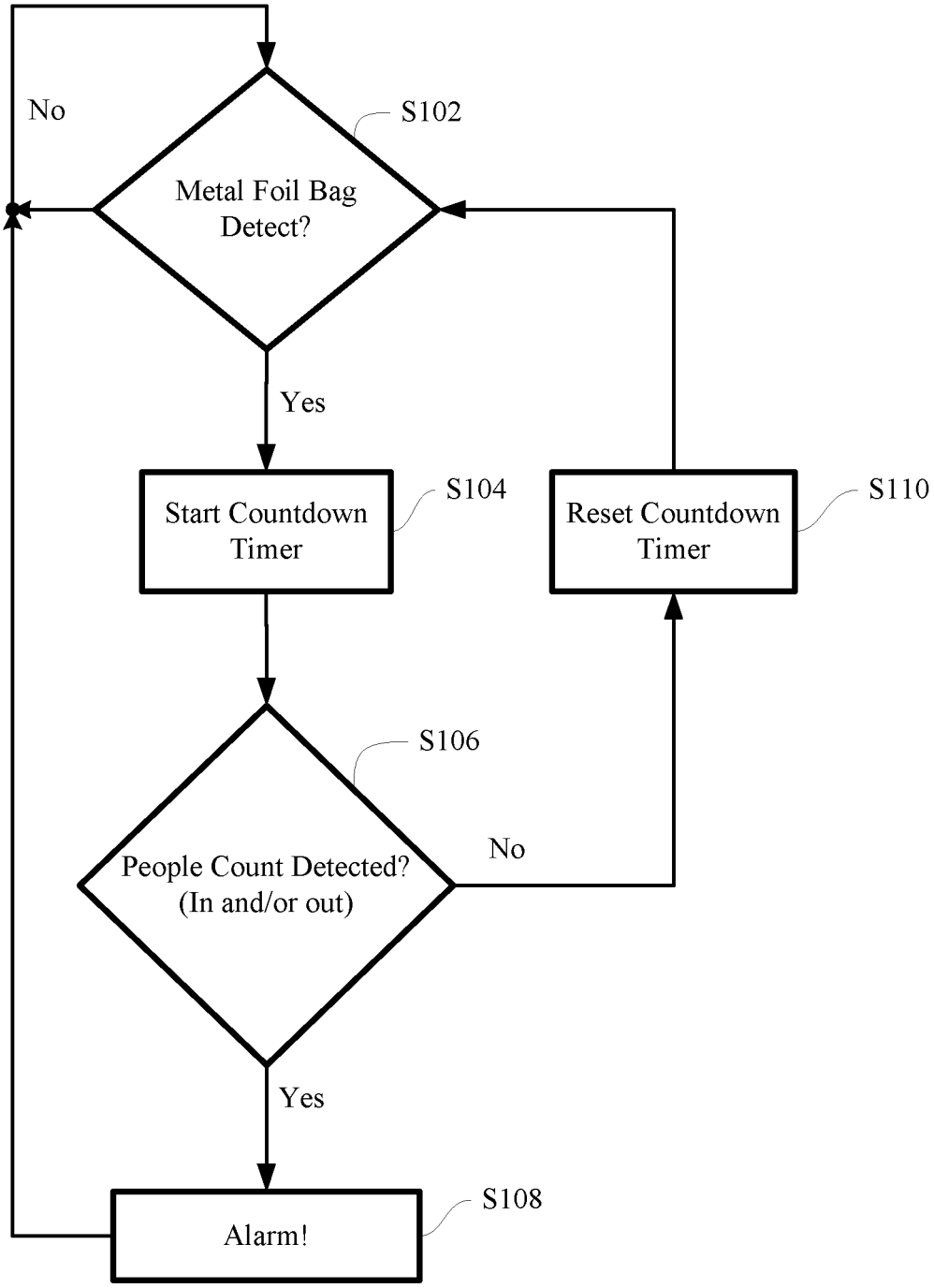
FIG. 3 is a flowchart of an exemplary metal detection process according to the principles of the present invention.

Referring now to FIG. 3, a flowchart is provided that describes exemplary steps performed by the EAS system 10 to determine whether detected metal may be a system circumvention device such as a metal foil-lined bag. The metal detector 18 runs in a continuous cycle as long as metal is not detected (step S102). When the metal detector 18 detects the presence of metal in or near the EAS interrogation zone (step S102), the metal detection module 42 instructs the real-time clock 44 to begin a countdown timer which counts for a predetermined amount of time (step S104), e.g., 1.25 sec. If the people counting system 20 detects people at or the EAS interrogation zone before the countdown timer reaches zero (step S106), then the metal detection module 42 triggers the alarm 32 (step S108). As noted above, the alarm 32 may include an audible and/or visual alarm, or may be a notification, such as a page, email, instant message, voice message, or text message, sent to in-store security or other authorized personnel.

Optionally, the people counting system 20 may include the ability to determine the direction that a person is moving. For example, the people counter 16 may include multiple microwave, or infrared zones, where each zone is occurs in a linear or sequential manner. The people counting system 20 can determine the direction the person is moving according to the sequence in which each zone is triggered. By forwarding this information to the metal detection module 42, the system controller may more accurately determine when there is a likelihood of the detected metal actually being a system circumvention device such as a metal foil-lined bag. Thus, the metal detection module 42 may only trigger the alarm 32 when the person is entering the facility. Although, it is more likely that a detected metal is a system circumvention metal, e.g., a foil-lined bag, when the person is entering the store, it is within the scope of this invention to trigger the alarm 32 only upon exiting the facility, as it is possible that a retailer may prefer to capture this scenario.

Returning now to FIG. 3, if the people counting system 20 does not detect people at or the EAS interrogation zone before the countdown timer reaches zero (step S106), then the countdown timer is reset (step S110) and the system returns to the continuous metal detection cycle (step S102). It should be noted that a "continuous metal detection cycle" may occur periodically in an allotted time frame within an EAS detection cycle.

Figure 4:
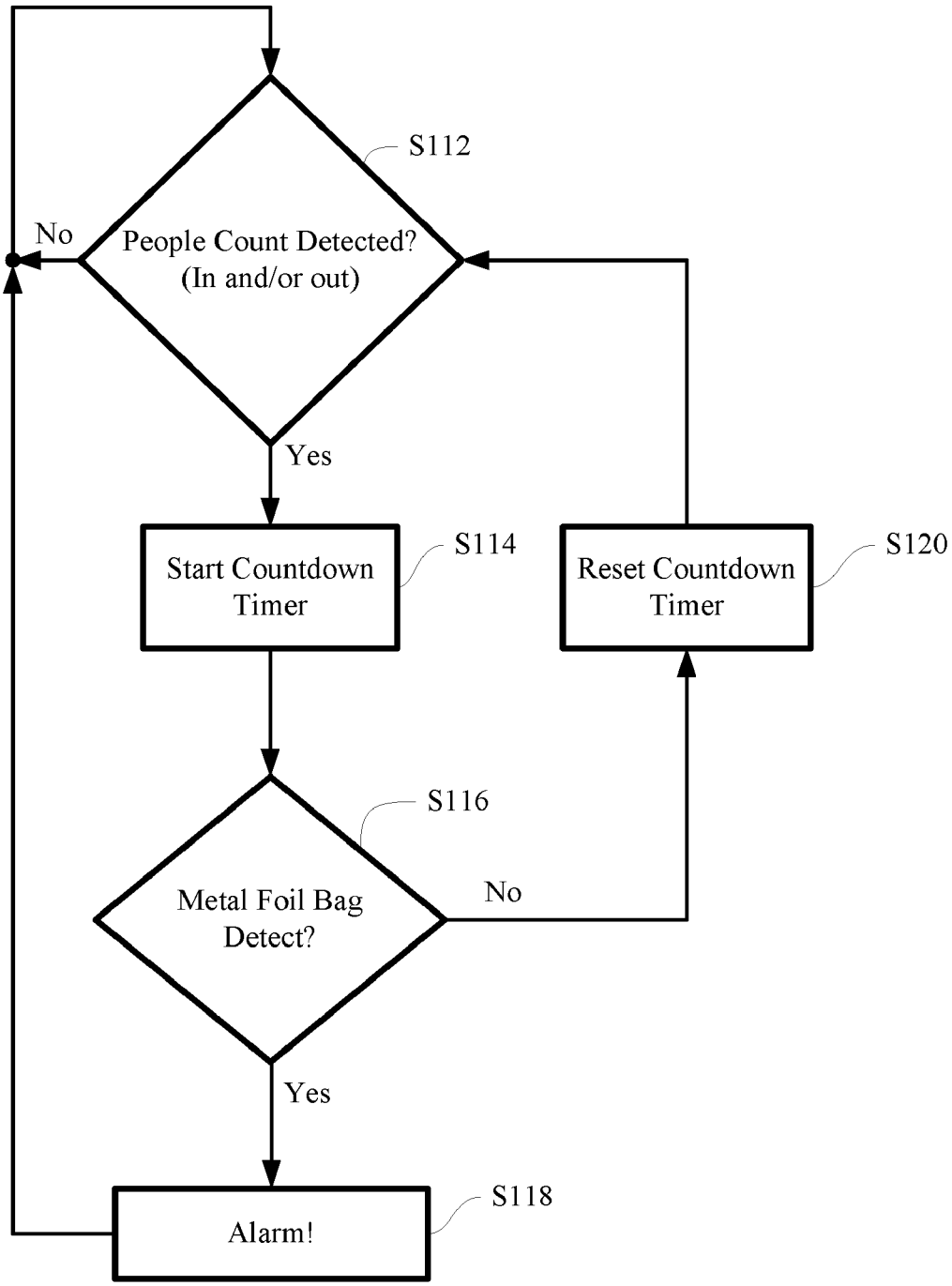
FIG. 4 is a flowchart of an exemplary metal detection process according to the principles of the present invention.

Referring now to FIG. 4, a flowchart is provided that describes alternative exemplary steps performed by the EAS system 10 to determine whether detected metal may be a foil-lined bag. The people counting system 20 runs in a continuous cycle as long as people are not detected in or near the EAS interrogation zone (step S112). When the people counting system 20 detects the presence of one or more persons in or near the EAS interrogation zone (step S112), the metal detection module 42 instructs the real-time clock 44 to begin a countdown timer which counts for a predetermined amount of time (step S114). As above, if the people counting system 20 is able to determine the direction that a person is moving, the metal detection module 42 may only instruct the real-time clock to begin counting down if the person is entering (or exiting) the facility. If the metal detector 18 detects metal at or the EAS interrogation zone before the countdown timer reaches zero (step S116), then the metal detection module 42 triggers the alarm 32 (step S118). However, if the metal detector 18 does not detect metal at or the EAS interrogation zone before the countdown timer reaches zero (step S116), then the countdown timer is reset (step S120) and the system returns to the continuous people detection cycle (step S112).

The present invention can be realized in hardware, software, or a combination of hardware and software. Any kind of computing system, or other apparatus adapted for carrying out the methods described herein, is suited to perform the functions described herein.

A typical combination of hardware and software could be a specialized computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A system for detecting electronic article surveillance ("EAS") marker shielding, the system comprising:
- an EAS subsystem operating to detect an EAS marker in an interrogation zone;
- a metal detector operating to detect a metal object in the interrogation zone;
- a people counting system operating to detect one or more people in the interrogation zone;
- a real time clock;
- a processor electrically coupled to the EAS subsystem, the metal detector and the people counting system, the processor programmed to:
  - receive information outputted from the people counting system and information outputted from the metal detector to determine whether to generate an alarm signal; and
  - generate the alarm signal responsive, at least in part, to:
    - the metal detector detecting the metal object in the interrogation zone; and
    - the people counting system detecting one or more people in proximity to the interrogation zone within a predetermined amount of time.

2. The system of claim 1, wherein the metal object is EAS marker shielding.

3. The system of claim 1, further comprising an alarm, the alarm operating to:
- receive the alarm signal; and
- produce at least one of an audible indicator and a visual indictor.

4. The system of claim 1, further comprising a communication interface operating to transmit the alarm signal.

5. The system of claim 1, wherein the people counting system further operates to determine a direction in which the one or more people are moving.

6. The system of claim 5, wherein the processor generates the alarm signal responsive, at least in part, to the people counting system detecting one or more people moving in a predetermined direction within the predetermined amount of time.

7. The system of claim 6, wherein the predetermined direction is entering a protected facility.

8. A method for detecting electronic article surveillance ("EAS") marker shielding, the method comprising:

providing an electronic article surveillance subsystem to detect electronic article surveillance markers within an interrogation zone;

detecting a metallic object within the interrogation zone;

providing a people counting subsystem to detect one or more people in the interrogation zone;

detecting the one or more people in proximity to the interrogation zone within a predetermined amount of time relative to detecting the metallic object within the interrogation zone; and responsive, at least in part, to detecting the one or more people in the interrogation zone, generating an alarm signal.

9. The method of claim 8, further wherein the metal object is EAS marker shielding.

10. The method of claim 8, further comprising transmitting the alarm signal.

11. The method of claim 8, further comprising:

receiving the alarm signal; and producing at least one of an audible indicator and a visual indictor.

12. The method of claim 8, further comprising determining a direction in which the one or more people are moving.

13. The method of claim 8, wherein the processor generates the alarm signal responsive, at least in part, to the people counting system detecting one or more people moving in a predetermined direction within a predetermined amount of time.

14. The method of claim 13, wherein the predetermined direction is entering a protected facility.

15. An electronic article surveillance system ("EAS") system controller comprising:

an EAS subsystem operating to detect an EAS marker in an interrogation zone;

a communication interface operating to receive inputs from a metal detector and a people counting system;

a real time clock;

a processor electrically coupled to the EAS subsystem and the communication interface, the processor programmed to:

receive information outputted from the people counting system and information outputted from the metal detector to determine whether to generate an alarm signal; and generate the alarm signal responsive, at least in part, to:

receiving a first indication that the metal detector has detected a metal object in the interrogation zone; and receiving a second indication that the people counting system has detected one or more people in the interrogation zone, the first indication and the second indication occurring within a predetermined amount of time.

16. The EAS system controller of claim 15, further comprising an alarm, the alarm operating to:

receive the alarm signal; and produce at least one of an audible indicator and a visual indictor.

17. The EAS system controller of claim 15, wherein the communication interface is further operating to receive an indication of a direction in which the one or more people are moving.

18. The EAS system controller of claim 17, wherein the processor generates the alarm signal responsive, at least in part, to determining that the one or more people are moving in a predetermined direction.

19. The EAS system controller of claim 18, wherein the predetermined direction is entering a protected facility.

* * * * *